United States Patent [19]

Giles

[11] 4,089,631

[45] May 16, 1978

[54] COAL-BURNING GAS TURBINE COMBUSTION SYSTEM FOR REDUCING TURBINE EROSION

[75] Inventor: Walter B. Giles, Scotia, N.Y.

[73] Assignee: General Electric Company, Schenectady, N.Y.

[21] Appl. No.: 725,696

[22] Filed: Sep. 23, 1976

[51] Int. Cl.[2] ..... F23M 9/00

[52] U.S. Cl. ..... 431/9; 110/204; 431/173; 110/260; 110/347

[58] Field of Search ..... 110/28 F, 7 S, 22 A, 110/8 R, 13, 8 F; 431/2, 173, 8, 9, 115, 116

[56] References Cited

U.S. PATENT DOCUMENTS

| | | | |
|---|---|---|---|
| 3,039,406 | 6/1962 | Aref | 110/28 F |
| 3,199,476 | 8/1965 | Nettel | 110/28 F |
| 3,855,951 | 12/1974 | Giles | 110/8 R |
| 3,885,906 | 5/1975 | Shurygin et al. | 110/28 F X |

*Primary Examiner*—Edward G. Favors

*Attorney, Agent, or Firm*—Marvin Snyder; Joseph T. Cohen; Jerome C. Squillaro

[57] ABSTRACT

Gas-fluidized ground coal, and coal dust slurried with fuel oil, are supplied to a reverse flow cyclone combustor which provides the functions of combustion and particulate removal. Coal dust borne by the fluidizing gas is passed through a cyclone scrubber utilizing fuel oil, and the resulting slurry is introduced into the combustor adjacent the inner surface of the combustor wall. Only the finest coal dust is employed in the slurry, to minimize oil consumption. Separative performance of the combustor is enhanced by introducing combustion air centrally adjacent the combustor outlet and gas-borne ground coal directly onto the cyclone walls.

21 Claims, 6 Drawing Figures

COAL-BURNING GAS TURBINE COMBUSTION SYSTEM FOR REDUCING TURBINE EROSION

INTRODUCTION

This invention relates to combustion systems, and more particularly to a method and apparatus for achieving improved particulate control in a cyclone combustor in which slurried coal, together with ground coal, is burned as fuel for a gas turbine, so as to mitigate turbine erosion.

Direct utilization of coal combustion necessitates considerable expense in hot gas clean-up. This is particularly true if the coal is to be employed in a gas turbine system with minimal turbine erosion and corrosion. A slagging cyclone combustor can provide a convenient means of combining the functions of combustion and particulate removal. Since cyclone combustors, especially at non-slagging temperatures, have a short solids residence time, it is desirable that they burn ground coal. Cyclone combustors operating at slagging temperatures can consume much coarser grades of coal, but these grades would also have, or produce, appreciable fines (i.e. coal dust or fly ash) which must be controlled to prevent excessive environmental air pollution or gas turbine erosion. Pre-processing methods of sulfur removal may also dictate the necessity for using ground coal. A cyclone separator of relatively small size can be quite effective for removing large particulates, while particulates smaller than 10 micrometers have minimal influence on turbine erosion. In the present invention, this provides a way of obtaining a sufficient improvement in cyclone separative efficiency to achieve the required stringent control of erosive particulates in a cyclone combustor for acceptable gas turbine machinery life.

In gas turbine energy production, the invention contemplates employment of gas-fluidized, ground coal as a feedstock to a pressurized cyclone combustor. The smallest coal dust particles (i.e. fines) from the fluidizing processes are passed through a cyclone scrubber utilized fuel oil, and a slurry pump introduces the combustible sludge produced by the scrubber into the combustor. Additionally, pulverized limestone may be premixed with the coal, as required, to absorb sulfur dioxide. By thus limiting the scrubber to producing an oil slurry of only the smallest coal dust particles, consumption of fuel oil is minimized.

The invention further contemplates use of a substantially conventional cyclone separator as a combustor, with improvements thereto to further control particulate carryover to downstream equipment and environment. To this end, a reverse flow cyclone of relatively long axial length is employed as a combustor in order to achieve good separative efficiency. Among the improvements are a base purge and conical vortex shield to inhibit reentrainment of fly ash into the exiting vortex core. Clean combustion air is admitted centrally into the cyclone combustor while ground coal (or a coal and limestone mixture) is borne by nitrogen (or flue gas) into the cyclone combustor near the cyclone wall by a relatively minor portion of the total combustion air.

Accordingly, one object of the invention is to enhance the separative performance of a cyclone combustor by minimizing presence of small particulates throughout the hot gas flow field while providing relatively small coal particles for rapid combustion.

Another object is to provide a method and apparatus for using coal as a gas turbine fuel with minimal turbine erosion and corrosion.

Another object is to produce an oil slurry of only very fine coal dust particles to minimize consumption of fuel oil in burning the slurry.

Another object is to provide a cyclone combustor for burning ground coal slurried with oil.

Another object is to provide a cyclone combustor in which a substantial quantity of clean combustion air is introduced between gas-borne ground coal and the cyclone combustor outlet so as to suppress an inlet eddy tending to convey feedstock particles directly to the combustor outlet.

Briefly, in accordance with a preferred embodiment of the invention, a combustion system for burning coal comprises cyclone combustor means including a substantially conical-to-cylindrical inner surface, a fluidized bed of ground coal, and means combining a liquid fuel with elutriated coal fines from the fluidized bed to form a slurry. Means are provided for supplying the slurry to the cyclone combustor means adjacent the inner surface of the cyclone combustor means, and additional means are provided for supplying ground coal particles above a predetermined size from the fluidized bed to a region radially-inward of the slurry in the cyclone combustion means.

In accordance with another preferred embodiment of the invention, a method of burning coal in a cyclone combustion system comprises combining a liquid fuel with coal fines to form a slurry, introducing the slurry along the inner surface of a cyclone combustor, and supplying ground coal particles above a predetermined size radially-inward of the slurry in the cyclone combustor.

In accordance with another embodiment of the invention, a cyclone combustor comprises a vertically-oriented combustion chamber including at least a substantially conical wall of diameter increasing with height over a predetermined height range from a minimum diameter to a maximum diameter. A base plug situated centrally at the bottom of the combustion chamber and extending upward therein is provided, the plus being located radially inward of the wall so as to allow clearance therebetween. Means are provided for introducing solid fuel in ground fluidized form at the top of the combustion chamber directed tangentially into the chamber, and additional means are provided for introducing air at the top of the combustion chamber directed tangentially into the chamber radially-inward of where the solid fuel is introduced therein.

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

DESCRIPTION OF TYPICAL EMBODIMENTS

Figure 1:
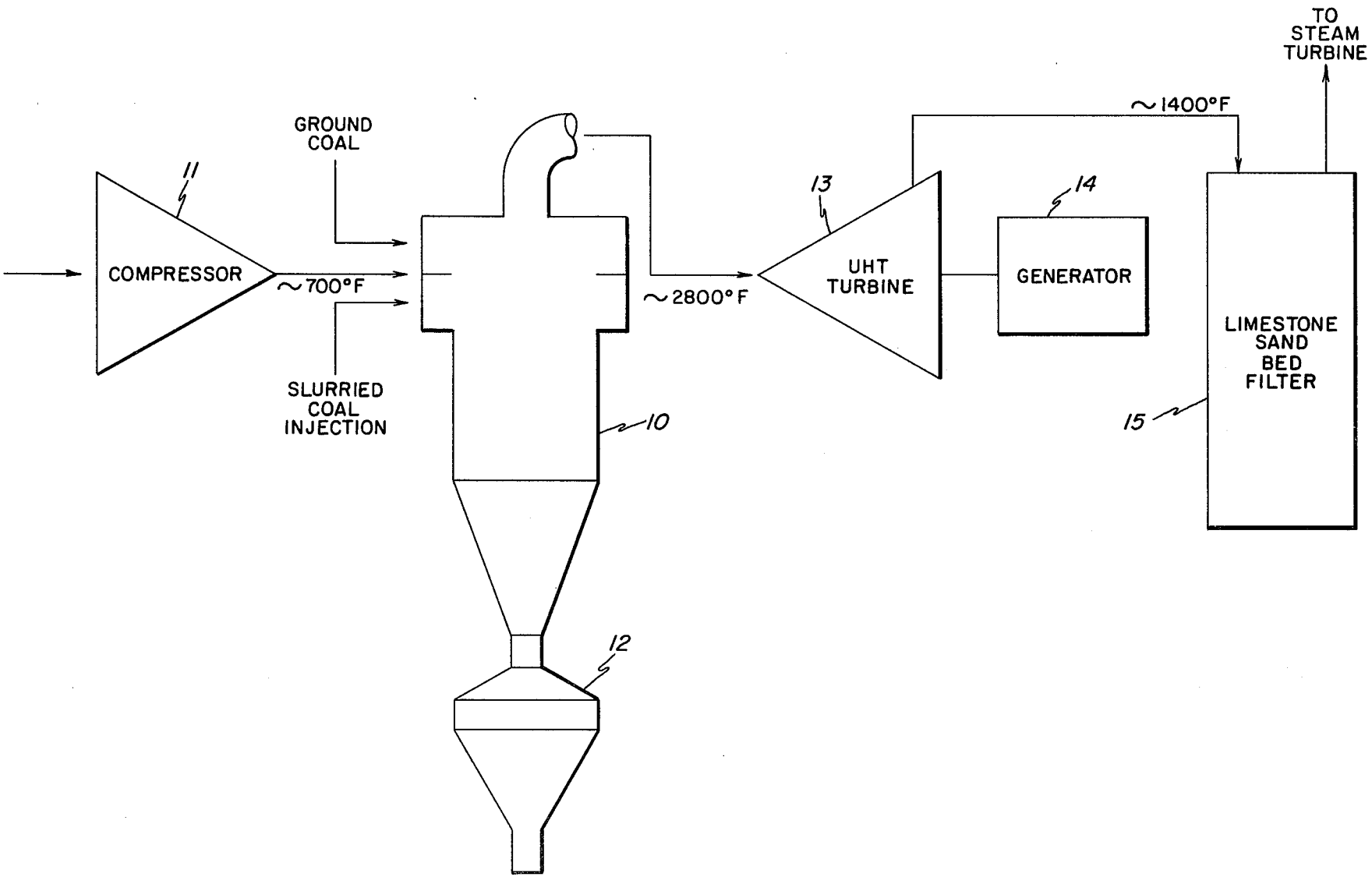
FIG. 1 is a schematic illustration of a gas turbine system employing a cyclone combustor in which ground and slurried coal is burned.

In FIG. 1, a pressurized slagging cyclone combustor 10 utilizing coal as an energy source is illustrated in an ultra high temperature gas turbine system, with exhaust heat utilized in a heat recovery steam generator — steam turbine system. The functions of combustion and particle size separation are performed within combustor 10; that is, the slurried coal is injected separately in a manner to minimize mixing with the combustion air and ensure that burning of the slurry takes place on the inner wall of cyclone combustor 10. Similarly, ground coal introduced with combustor air is supplied to the interior region of cyclone combustor 10 so as to burn within a region surrounded by, and radially-inward of, the slurry. Combustor air may be furnished by a compressor 11, typically at a temperature of about 700° F. The products of combustion are collected in a lock hopper 12.

An ultra high temperature (UHT) turbine 13 is driven by hot gases which are emitted from combustor 10 at a temperature in the range of 2600° F to 2900° F, such as 2800° F. Particulate emissions in these hot gases may be kept to less than 10 micrometers in size, allowing a reasonable erosive life for the gas turbine in the presence of particulates in the gas stream. An electrical generator 14 is driven by turbine 13.

Exhaust heat from turbine 13 is supplied to a limestone sand bed filter 15 at a temperature of approximately 1400° F. Filter 15 controls sulfur emission. Exhaust gases from filter 15, still being at a relatively high temperature, may then be utilized in a heat recovery steam generator (not shown) to produce steam for driving a steam turbine (not shown).

Figure 2:
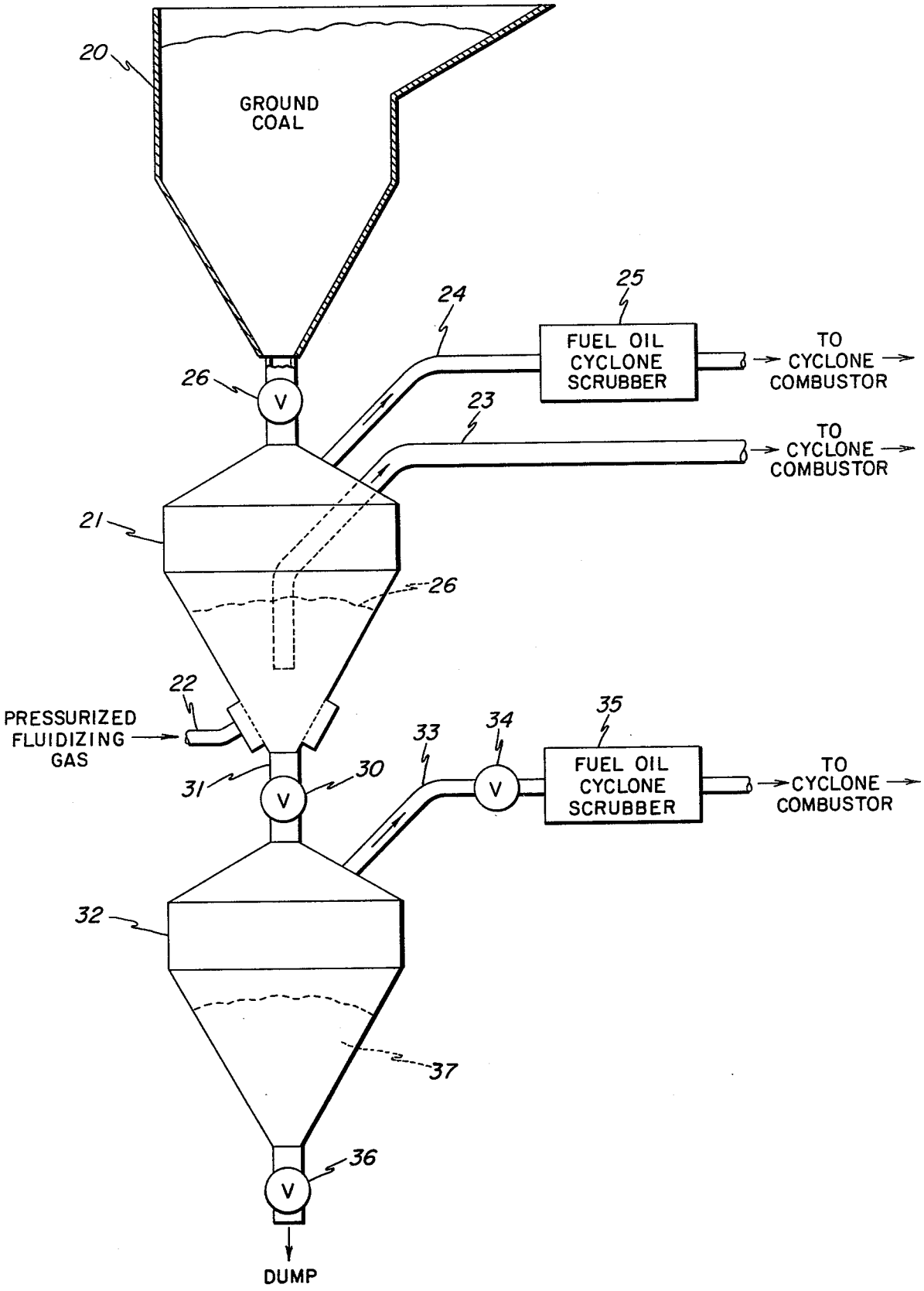
FIG. 2 is a schematic illustration of a pressurized coal-fluidizing system having a pressure release flow vented to a fuel oil cyclone scrubber.

FIG. 2 illustrates a method of combustor fuel preparation in which coal dust is combined with fuel oil. Feedstock comprising ground coal (together with pulverized limestone or dolomite if necessary to reduce sulfur dioxide emission, and provided reaction temperatures are not so high as to preclude chemical reaction between the limestone or dolomite and $SO_2$) is supplied from a hopper 20 to a pressure vessel or lock hopper 21 containing a gas-fluidized coal bed, conveniently one in which flue gas or nitrogen is used as the fluidizing gas, and is supplied to the lowermost portion of lock hopper 21 through an inlet line 22. Those skilled in the art will recognize that additives such as limestone or dolomite will reduce the temperature at which slagging in the combustor will occur, allowing slagging of the fly ash therein for more effective particulate control at lower turbine operating temperatures. The fluidized bed is comprised of ground coal maintained in a highly agitated state by virtue of upward-flowing fluidizing gas.

Ground coal from lock hopper 21, with the fines removed, is furnished directly into an inlet line 23 of a cyclone combustor, together with fluidizing gas. Cyclone combustor inlet line 23 extends into pressure vessel 21 below the pseudo-liquid level or surface 26 of the fluidized ground coal bed therein, in order to obtain ground coal for combustion from pressure vessel 21. Removal of the fines from pressure vessel 21 is accomplished by venting the fluidizing gas, bearing elutriated coal dust, through an outlet line 24 to a fuel oil cyclone scrubber 25 in which the fines are converted to a slurry by being mixed with fuel oil. The supply of coal from hopper 20 to pressure vessel 21 may be controlled by a valve 26 therebetween.

Coarse feedstock, being relatively heavy, drops from the fluidized bed in pressure vessel 21 through a valve 30 in a coarse feedstock bypass line 31 into a pressure vessel or lock hopper 32. Pressure release flow from lock hopper 32 is vented through an outlet line 33, containing a pressure release control valve 34 therein, to a fuel oil cyclone scrubber 35. Lock hopper 32 collects coarse feedstock particles 37, which can be dumped through a valve 36 for reworking into smaller particles.

Figure 3:
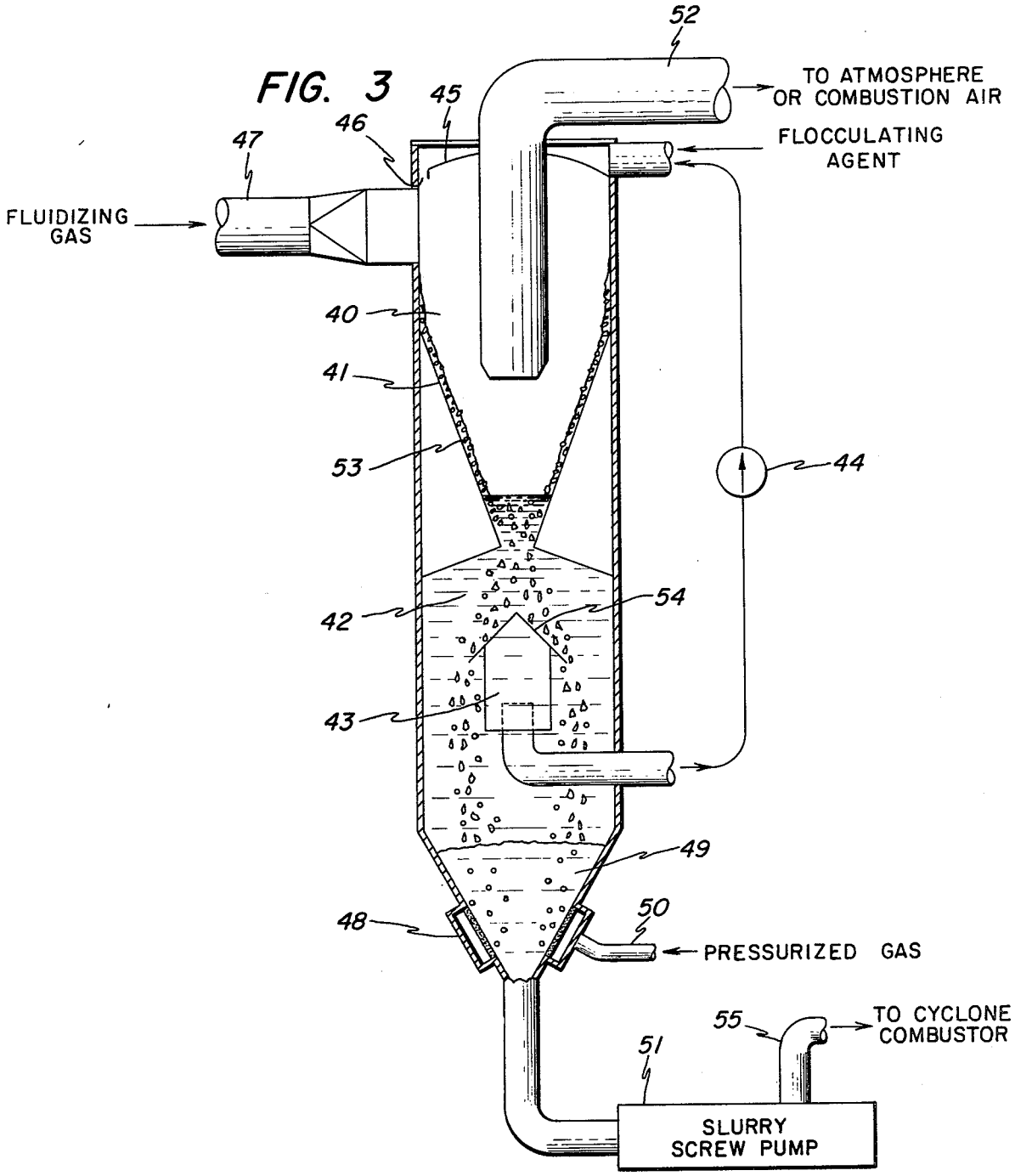
FIG. 3 is a schematic illustration of a fuel oil cyclone scrubber for use with the apparatus of FIG. 2.

FIG. 3 schematically illustrates a typical fuel oil scrubber for use in the present invention. The scrubber comprises a vertically-oriented mixing chamber 40 having a substantially conical-to-cylindrical wall 41 of diameter increasing with height over a predetermined height range from a minimum diameter to a maximum diameter, with chamber 40 extending upward at its maximum diameter for an additional distance above the conical portion of wall 41.

A settling chamber 42 situated beneath mixing chamber 40 contains a screened intake 43 therein, the openings of which allow any unmixed fuel oil to pass through and be recirculated, through a centrifugal recirculation pump 44, to the top of mixing chamber 40 above a drip tray 45, where it enters together with a flocculating agent, such as polyisobutylene, to aid particulate fallout in settling tank 42. The fuel oil drips through an opening 46 which situates it directly in the path of incoming fluidizing gas-borne fines entering through an inlet 47 directed tangentially into the upper portion of mixing chamber 40 below drip tray 45. Alternatively, the oil may be sprayed into intimate contact with the fines, as in a venturi scrubber. The tangential entry of inlet 47 to mixing chamber 40 is best illustrated in FIG. 4, which is a top view of the fuel oil scrubber of FIG. 3.

Fuel oil mixed with fines, being of a viscocity too thick to penetrate screened intake 43, is substantially shielded by upper conical surface 54 from directly contacting the screened intake and falls to the bottom of settling chamber 42 to form a sludge 49. This sludge is prevented from excessive compacting by a stirring device to agitate the slurry, such as a gas bubbler 48 which is preferably driven by pressurized gas entering through an inlet 50. A slurry screw pump 51 draws off the sludge and supplies it to the wall region of a cyclone combustor through an output line 55. Scrubbed fluidizing gas is exhausted to atmosphere through a stack 52 or, alternatively, may be supplied along with combustion air to the combustor.

Figure 4:
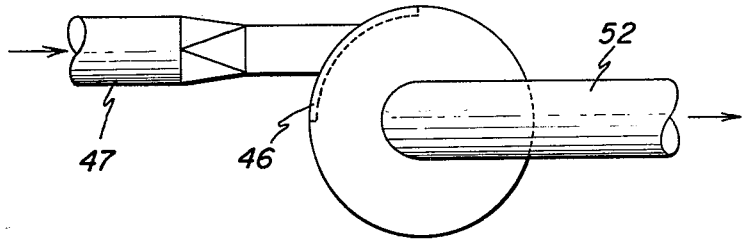
FIG. 4 is a top view of the fuel oil cyclone scrubber shown in FIG. 3.

Thus the cyclone separator of FIGS. 3 and 4 admits fluidizing gas, bearing fines, into mixing chamber 40. The fluidizing gas, bearing fines, swirls through chamber 40 and mixes with recirculated fuel oil 53, carrying a flocculating agent, as it passes downward over the inner surface of mixing chamber wall 41. The sludge that thus accumulates in settling chamber 42 is used for burning on the wall surfaces of the combustor.

Figure 5:
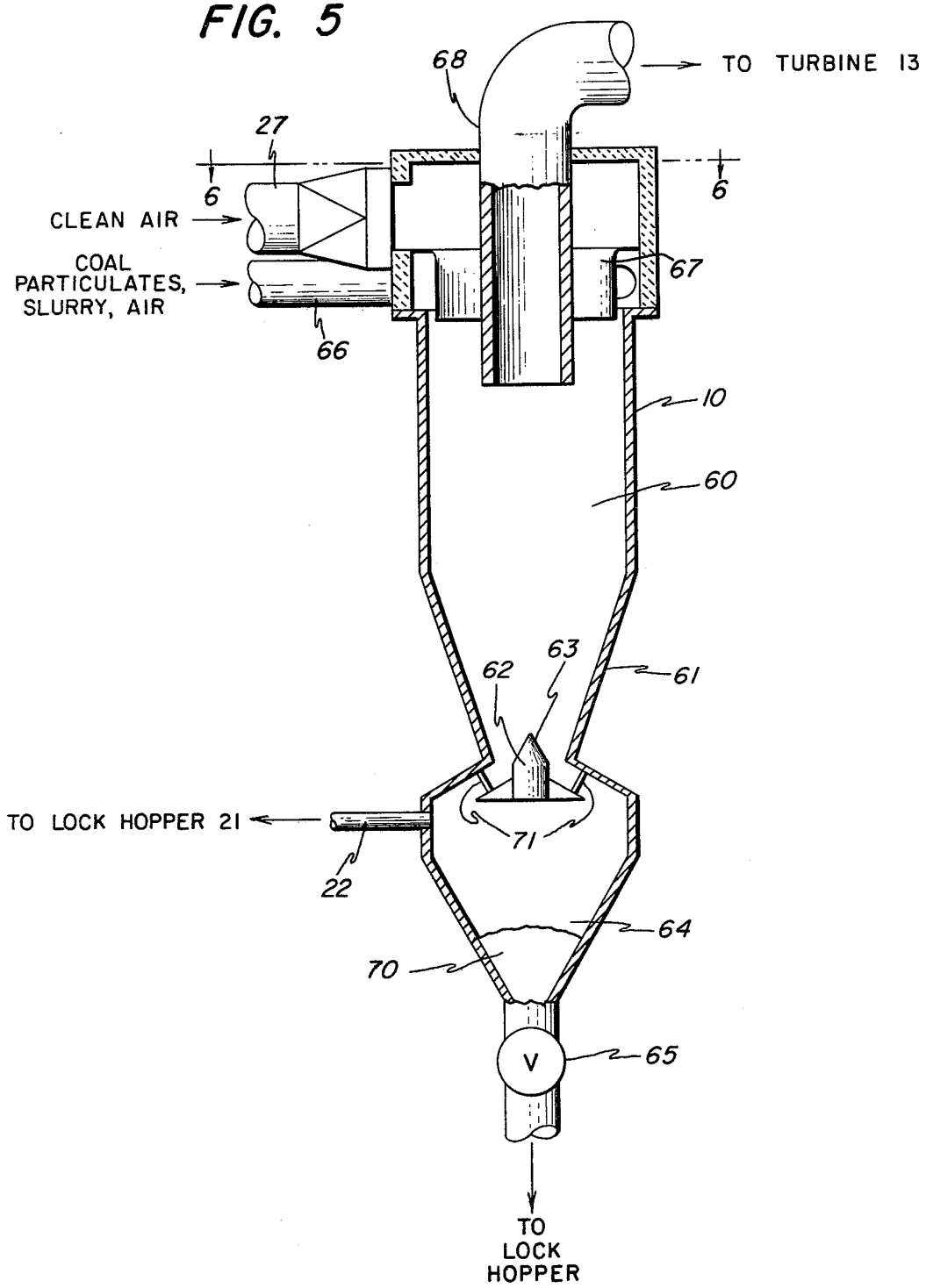
FIG. 5 is a schematic illustration of a cyclone combustor for use in the gas turbine system of FIG. 1.

FIG. 5 illustrates schematically the configuration of combustor 10 employed in the apparatus shown in FIG. 1. The combustor comprises a vertically-oriented combustion chamber 60 of axial length to maximum diameter ratio of about 3 to 4 and having a substantially conical-to-cylindrical wall 61 so as to exhibit a diameter increasing linearly with weight, over a predetermined height range, from a minimum diameter to a maximum diameter. Chamber 60 extends upward at its maximum diameter for an additional distance above the inclined portion of wall 61. A base plug 62 situated centrally at the bottom of combustion chamber 60 on supports 71 has a substantially conical portion 63 extending upward into the combustion chamber to shield any source of base purge vacuum from the vortex core flow at the bottom of the chamber and thereby reduce upward flow of particulates in the chamber. Base plug 62 is of smaller diameter than the minimum diameter of combustion chamber 60 in order to permit escape of molten slag from the combustion chamber to slag collection chamber 64. Molten slag 70 may be drawn off through a valve 65 and supplied to a lock hopper (not shown) where it is chilled and retained until its removal is desired.

Figure 6:
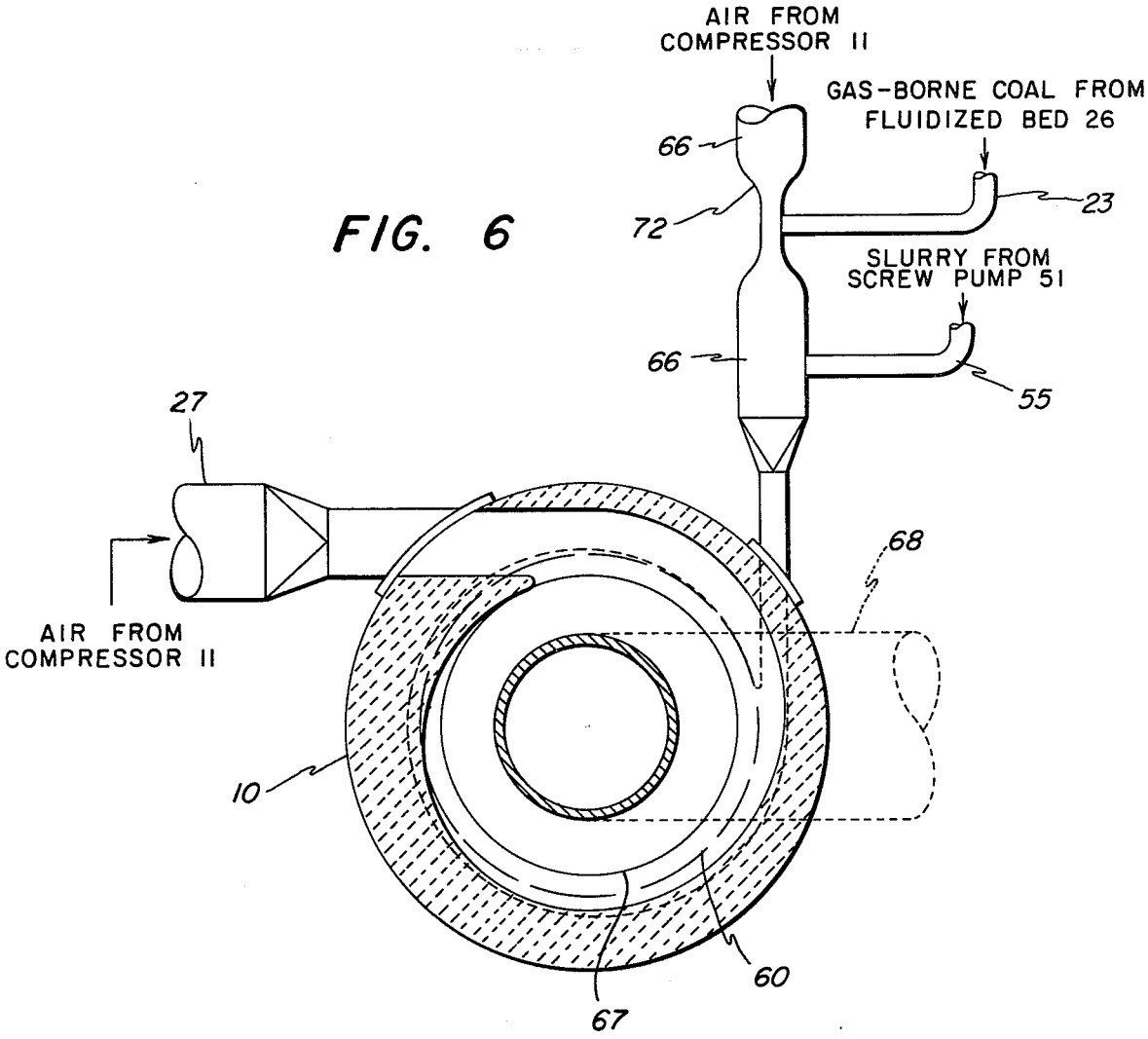
FIG. 6 is a section view taken along line 6—6 of FIG. 5, and includes an extended view of inlet line 66.

Clean air from compressor 11 shown in FIG. 1 is supplied to inlet line 66 containing therein an ejector 72, as shown in FIG. 6, which is a sectional view taken along line 6—6 in FIG. 5 and includes an extended view of inlet line 66 to illustrate input connections thereto. Fluidized ground coal particles from pressure vessel 21, shown in FIG. 2, are supplied to the narrow or throat portion of ejector 72 through supply line 23, as shown in FIG. 6. Slurry injection into inlet line 66 from pump 51, shown in FIG. 3, takes place through screw pump outlet line 55, the slurry being deposited on the inside surface of the outer portion of inlet line 66 with respect to the circular cross-sectional configuration of combustion chamber 60 as shown in FIG. 6. Thus fluidized coal particles are introduced from inlet line 66 into the top of combustion chamber 60 cut side separator wall 67, directed tangentially into the chamber radially-inward of the slurry supplied through inlet line 66. Centrifugal force thus ensures that the slurry is burned at the inner surface of wall 61, while the particulate matter is burned in a region encircled by the slurry.

Clean air is also supplied from compressor 11 to inlet line 27 of combustor 10. Air supplied to inlet line 66 constitutes a relatively minor component of the total combustion air (i.e. less than 30%), the remainder being supplied through inlet line 27.

A base purge line 22 is provided, leading out of slag collection chamber 64 to pressurize the fluidized bed of lock hopper 21, shown in FIG. 2. Base purge line 22 extends out of chamber 64 above the level of molten slag therein, in order to enhance separative performance of the cyclone and thus can be used, with cooling, as a source of fluidizing gas at operating pressure driven by aspiration into ejector 72 situated in inlet line 66 which dispenses fuel along the inner surface of wall 61. Thus ejector 72 creates a suction source for base purge 22 and may also serve to pressurize fluidized beds in the system. Hot gases from combustor 10 may be supplied through an output line 68 to the input of gas turbine 13, shown in FIG. 1.

It will be recognized that inlet flows into combustor 10 are preconditioned with adequate swirl length, due to the extension of output line 66 into combustion chamber 60, so as to suppress any inlet eddys tending to short-circuit particulate flow from inlet line 66 to output line 68. This suppression is assisted by the entry of clean combustion air from inlet line 27 between output line 68 and separator wall 67 which separates the clean combustion air from the entering fuel from inlet line 66. Consequently, full reverse flow occurs in cyclyone combustor 10, from the inlet lines to the base of combustion chamber 60 and back to output line 68.

Accordingly, by use of a coal-fuel oil slurry, small particulates may be introduced into the combustion as constituents of large, easily centrifuged droplets. With specific gravities of 1.5, 2.5, and 0.9 for coal, limestone, and fuel oil, respectively, fluid slurries of 35% to 40% coal may be employed. By grading the ground feedstocks to a fine and coarse cut (such as by the classifying action of the fluidizing gas), with only the fine cut slurried with fuel oil, fuel oil comsumption may be held to a relatively low value while enhancing particulate control in the combustor. Moreover, combustion is such that the particulates, because of their swirling motion, move rapidly outward into the wall-burning zone of the combustion chamber, and the molten ash in slag collection chamber 64 tends to entrain flyash particles from the wall region.

The foregoing describes a method and apparatus for enhancing the separative performance of a cyclone combustor by minimizing presence of small particulates throughout the hot gas flow field while providing relatively small coal particles for rapid combustion. An oil slurry of only very fine coal dust particles is employed to minimize combustion of fuel oil in burning the slurry, enabling a gas turbine system to use coal as a fuel while undergoing minimal erosion and corrosion. The hot gases produced by the combustion process may, alternatively, be employed for other processes, such as supplying heat for a steam turbine. An inlet eddy of the cyclone combustor tending to convey feedstock particles directly to the combustor outlet is suppressed therein.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

I claim:

1. A combustion system for burning coal comprising:
combustor means including a substantially conical-to-cylindrical surface;
a fluidized bed of ground coal;
mixing means combining a liquid fuel with elutriated coal fines from said fluidized bed to form a slurry;
means coupling said mixing means to said cyclone combustor means for supplying said slurry adjacent the inner surface of said cyclone combustor means; and
means coupling said fluidized bed to said cyclone combustor means for supplying ground coal particles above a predetermined size from said fluidized bed to a region radially-inward of said slurry in said cyclone combustion means.

2. The apparatus of claim 1 wherein said mixing means comprises a cyclone scrubber.

3. The apparatus of claim 1 wherein said liquid fuel comprises fuel oil.

4. The apparatus of claim 1 wherein said ground coal in said fluidized particulate bed is intermixed with particles absorbent to sulfur dioxide.

5. In a cyclone combustion system, a method of burning coal comprising:
combining a liquid fuel with coal fines to form a slurry;
introducing said slurry along the inner surface of a cyclone combustor; and supplying ground coal particles radially-inward of said slurry in said cyclone combustor.

6. The method of claim 5 wherein the step of combining a liquid fuel with coal fines comprises scrubbing said coal fines with fuel oil.

7. The method of claim 5 including the step of recirculating unburned vapors in said system back into said cyclone combustor.

8. The method of claim 5 including the step of pressurizing a fluidized bed of ground coal with base purge gases from said cyclone combustion system so as to provide said coal fines and said ground coal particles for consumption in said cyclone combustor.

9. The method of claim 8 wherein said base purge gases are recirculated to said cyclone combustor.

10. A cyclone combustor comprising:

a vertically-oriented combustion chamber including at least a substantially conical wall of diameter increasing with height over a predetermined height range from a minimum diameter to a maximum diameter;

a base plug situated centrally at the bottom of said combination chamber and extending upward therein, said plug being located radially-inward of said wall so as to allow clearance therebetween;

means for introducing solid fuel in ground fluidized form at the top of said combustion chamber directed tangentially into said chamber; and means for introducing air at the top of said combustion chamber directed tangentially into said chamber radially-inward of where said solid fuel is introduced therein.

11. The cyclone combustor of claim 10 wherein the portion of said base plug extending upward into said combustion chamber is of substantially conical shape.

12. The cyclone combustor of claim 10 including a slag collection chamber beneath said combustion chamber.

13. The cyclone combustor of claim 12 including means for conveying gases from said slag collection chamber to said means for introducing solid fuel into said combustion chamber.

14. The cyclone combustor of claim 11 wherein said wall is of said maximum diameter for an additional height above said predetermined height range.

15. The cyclone combustor of claim 14 including a slag collection chamber beneath said combustion chamber, and means for conveying gases from said slag collection chamber to said means for introducing a solid fuel into said combustion chamber.

16. The cyclone combustor of claim 10 including means for introducing a slurry of fuel at the top of said combustion chamber directed tangentially into said chamber along the wall thereof radially-outward of solid fuel in ground fluidized form, said slurry comprising fine solid fuel particles in a liquid fuel.

17. The cyclone combustor of claim 16 wherein the portion of said base plug extending upward into said combustion chamber is of substantially conical shape.

18. The cyclone combustor of claim 16 including a slag collection chamber beneath said combustion chamber.

19. The cyclone combustor of claim 18 including means for conveying gases from said slag collection chamber to said means for introducing solid fuel into said combustion chamber.

20. The cyclone combustor of claim 17 wherein said wall is of said maximum diameter for an additional height above said predetermined height range.

21. The cyclone combustor of claim 20 including a slag collection chamber beneath said combustion chamber, and means for conveying gases from said slag collection chamber to said means for introducing a solid fuel into said combustion chamber.

* * * * *